US006781063B2

(12) United States Patent
Kim et al.

(10) Patent No.: US 6,781,063 B2
(45) Date of Patent: Aug. 24, 2004

(54) MULTI-LAYER INSULATION SYSTEM FOR ELECTRICAL CONDUCTORS

(75) Inventors: Young Joon Kim, Greenfield, MA (US); Zeng Wan, Greenfield, MA (US); Jun Hong Yi, Greenfield, MA (US)

(73) Assignee: Judd Wire, Inc., Turners Falls, MA (US)

( * ) Notice: Subject to any disclaimer, the term of this patent is extended or adjusted under 35 U.S.C. 154(b) by 80 days.

(21) Appl. No.: 10/124,896

(22) Filed: Apr. 17, 2002

(65) Prior Publication Data

US 2003/0062190 A1 Apr. 3, 2003

Related U.S. Application Data

(60) Provisional application No. 60/284,302, filed on Apr. 17, 2001.

(51) Int. Cl.[7] ..... H01B 17/00

(52) U.S. Cl. ..... 174/149 R; 174/137 R; 174/138 R; 174/120 C

(58) Field of Search ..... 174/149 R, 137 R, 174/138 R, 138 C, 120 R, 120 C

(56) References Cited

U.S. PATENT DOCUMENTS

| | | | |
|---|---|---|---|
| 3,269,862 | A | 8/1966 | Lanza et al. |
| 3,408,453 | A | 10/1968 | Shelton, Jr. |
| 3,422,215 | A | 1/1969 | Humes |
| 3,488,537 | A | 1/1970 | Beddows |
| 3,763,222 | A | 10/1973 | Aronoff et al. |
| 3,852,518 | A | 12/1974 | Wargotz et al. |
| 3,894,118 | A | 7/1975 | Aronoff et al. |
| 3,911,192 | A | 10/1975 | Aronoff et al. |
| 3,970,770 | A | 7/1976 | Dhami |
| 3,995,091 | A | 11/1976 | Dhami |
| 4,031,167 | A | 6/1977 | Aronoff et al. |
| 4,155,823 | A | 5/1979 | Gotcher et al. |
| 4,184,001 | A | 1/1980 | Hildreth |
| 4,310,597 | A | 1/1982 | Checkland et al. |
| 4,353,961 | A | 10/1982 | Gotcher et al. |
| 4,401,845 | A | 8/1983 | Odhner et al. |
| 4,430,385 | A | 2/1984 | Dillow et al. |
| 4,451,306 | A | 5/1984 | Verne |
| 4,628,003 | A | 12/1986 | Katz |
| 4,791,966 | A | 12/1988 | Eilentropp |
| 4,801,501 | A | 1/1989 | Harlow |
| 5,059,483 | A | 10/1991 | Lunk et al. |
| 5,220,133 | A | 6/1993 | Sutherland et al. |
| 5,399,434 | A | 3/1995 | Katz et al. |
| 5,731,088 | A | 3/1998 | La Court |

FOREIGN PATENT DOCUMENTS

| | | | |
|---|---|---|---|
| CN | 1066817 | A | 12/1992 |
| DE | 2053960 | A | 5/1972 |
| JP | 4052570 | A | 2/1992 |
| WO | PCT/US90/00981 | | 9/1990 |

OTHER PUBLICATIONS

Solomon et al., *New Insulation Constructions for Aerospace Wiring Applications*, vol. I: Testing and Evaluation, at 1.0 Introduction, 2.0 Description of Test Article, 11.0 Overall Summary, 12.0 Observations, 13.0 Conclusions and Recommendations, McDonnel Douglas Corporation/Wright Laboratory (Jun. 1991).

Solomon et al., *New Insulation Constructions for Aerospace Wiring Applications*, vol. II: 270 VDC Arc Tracking Testing with Power Controllers at 1.0 Introduction, 5.0 Conclusions, McDonnel Douglas Corporation/Wright Laboratory (Jun. 1991).

*Primary Examiner*—Anthony Dinkins
*Assistant Examiner*—Jinhee Lee
(74) *Attorney, Agent, or Firm*—Holland & Bonzagni, P.C.; Mary R. Bonzagni, Esq.

(57) ABSTRACT

A multi-layer insulation system for electrical conductors, an insulated electrical conductor, a process for preparing an insulated conductor, and an insulated conductor prepared by such a process are provided. The insulated electrical conductors are lightweight, qualify for temperature ratings of up to approximately 230° C., and demonstrate mechanical durability and hydrolysis resistance. As such, these insulated conductors are particularly useful for aircraft wire and cable.

34 Claims, 2 Drawing Sheets

MULTI-LAYER INSULATION SYSTEM FOR ELECTRICAL CONDUCTORS

RELATED APPLICATION

This application claims the benefit of U.S. Provisional Patent Application Serial No. 60/284,302, filed Apr. 17, 2001.

TECHNICAL FIELD OF THE INVENTION

The present invention basically relates to a multi-layer insulation system for electrical conductors, an insulated electrical conductor, a process for preparing an insulated conductor, and an insulated conductor prepared by such a process. The insulated electrical conductors of the present invention are lightweight, qualify for temperature ratings of up to approximately 230° C., and demonstrate mechanical durability, and hydrolysis resistance. As such, these insulated conductors are particularly useful for aircraft wire and cable.

BACKGROUND OF THE INVENTION

Electrical insulation must meet a variety of construction and performance requirements. These requirements are particularly severe for electrical cable which is to be used in aircraft and similar equipment. Electrical cable useful for such applications must demonstrate a balance of electrical, thermal, and mechanical properties, with overall performance being evaluated by assessing properties such as abrasion and cut-through resistance, chemical and fluid resistance, dry and wet arc tracking, and flammability and smoke generation. At the same time, such cables must adhere to rigid weight limitations.

Aircraft wire constructions comprising a polyimide inner layer, and a polytetrafluoroethylene (PTFE) outer layer, are known. In such constructions, the polyimide inner layer is formed by spiral-wrapping an adhesive (e.g., PTFE, fluorinated ethylene-propylene (FEP), or perfluoroalkoxy (PFA))-coated polyimide tape, in an overlapping fashion, about a conductor. The spiral-wrapped polyimide tape is heat-sealed at the spiral-wrapped tape joints. The PTFE outer layer is formed by spiral-wrapping unsintered PTFE tape about the heat-sealed polyimide inner layer. The unsintered PTFE tape outer layer is also heat-sealed at the spiral-wrapped joints by sintering the wrapped tape.

The above-referenced aircraft wire constructions have a temperature rating of approximately 260° C., and while demonstrating good mechanical durability, these wire constructions provide only low-to-moderate long-term humidity resistance and laser markability properties. In addition, the PTFE outer layer is easily scrapped off, thereby exposing the inner layer and rendering it susceptible to hydrolysis in humid environments.

As will be readily apparent to those skilled in the art, the aircraft wire constructions described above do not employ a radiation crosslinked outer layer, where exposing perfluorinated polymers such as PTFE, FEP, and PFA to radiation would serve to degrade these materials.

Aircraft wire constructions comprising one or more layers of extruded ethylene tetrafluoroethylene (ETFE) copolymer, are also known. In such constructions, the ETFE copolymer layer(s) is generally crosslinked by irradiation to achieve use-temperature ratings of greater than 150° to 200° C. The reduction in use-temperature ratings is partially offset by the fact that these wire constructions demonstrate mechanical durability, long-term humidity resistance, and laser markability properties which are superior to those noted above for polyimide/PTFE wire constructions.

A need therefore exists for an aircraft wire construction which qualifies for higher use-temperatures, while demonstrating improved mechanical durability, long-term humidity resistance, and laser markabilty properties.

It is therefore an object of the present invention to provide such an insulated wire construction.

It is a more particular object to provide a multi-layer insulation system for electrical conductors.

It is another more particular object of the present invention, to provide a lightweight insulated electrical conductor prepared using the above-referenced multi-layer insulation system, which qualifies for a temperature rating of up to approximately 230° C., and which demonstrates improved mechanical durability, and hydrolysis resistance.

It is yet another more particular object to provide an insulated electrical conductor that further demonstrates flame resistance and laser markability.

It is a further object of the present invention to provide a process for preparing such an insulated conductor, and an insulated conductor prepared by such a process.

SUMMARY

The present invention therefore provides a multi-layer insulation system for electrical conductors, which comprises:

(a) a polyimide or fluoropolymer inner layer, wherein, when the inner layer is a polyimide inner layer, the layer is formed by wrapping a polyimide film, which has been coated with a sealable component, in an overlapping fashion, along a portion or length of an electrical conductor, wherein the polyimide film is substantially uniformly sealed to itself in overlapping regions along the length of the conductor, thereby forming an effective seal against moisture, wherein the sealable component comprises a perfluoropolymer, a crosslinked fluoropolymer, or a polyimide adhesive, wherein, when the inner layer is a fluoropolymer inner layer, the layer is formed by either extruding a fluoropolymer material along a portion or length of the electrical conductor, or by wrapping a fluoropolymer film, in an overlapping fashion, along a portion or length of the conductor, (b) optionally, a polyimide middle layer, wherein the polyimide middle layer is formed by wrapping an optionally coated polyimide film, in an overlapping fashion, along a portion or length of the inner layer formed on the electrical conductor, and (c) an extruded, crosslinked fluoropolymer outer layer, wherein the fluoropolymer is selected from the group consisting of copolymers and terpolymers of ethylene-tetrafluoroethylene, and mixtures thereof, wherein, when the inner layer is a fluoropolymer inner layer, the multi-layer insulation system includes a polyimide middle layer.

The present invention also provides an insulated electrical conductor that comprises an electrical conductor insulated with the multi-layer insulation system described above.

The present invention further provides a process for preparing an insulated electrical conductor, which comprises:

(a) forming a polyimide or fluoropolymer inner layer on an electrical conductor, wherein, when the inner layer is a polyimide inner layer, the layer is formed by wrapping a polyimide film, which has been coated with a sealable component, in an overlapping fashion, along a portion or length of the electrical conductor, wherein the sealable component comprises a perfluoropolymer, a crosslinked fluoropolymer, or a polyimide adhesive, wherein, when the inner layer is a fluoropolymer inner layer, the layer is formed by either: i) extruding a fluoropolymer material along a portion or length of the electrical conductor, or ii) wrapping a fluoropolymer film, in an overlapping fashion, along a portion or length of the electrical conductor, (b) optionally, forming a polyimide middle layer on the polyimide or fluoropolymer inner layer by wrapping an optionally coated polyimide film, in an overlapping fashion, along a portion or length of the inner layer, (c) when the inner layer is a polyimide inner layer or when a middle layer is formed using a coated polyimide film, heating the polyimide film or films to a temperature ranging from about 240° to about 350° C. to cause overlapping regions of the coated film or films to bond, thereby forming an effective seal against moisture along the length of the conductor, (d) forming a fluoropolymer outer layer on either the inner or middle layer by extruding a fluoropolymer material along a portion or length of that layer; and (e) crosslinking the fluoropolymer outer layer, wherein, when the inner layer or the sealable component comprises a perfluoropolymer (e.g., polytetrafluoroethylene, fluorinated ethylene propylene copolymers, perfluoroalkoxy resins), the fluoropolymer outer layer is crosslinked by exposing it to less than 60 megarads of radiation, with applied voltages ranging from about 50 to about 120 kilo volts, wherein, when the inner layer is a fluoropolymer inner layer, the process for preparing an insulated electrical conductor includes forming a polyimide middle layer on the fluoropolymer inner layer.

The present invention also provides an insulated electrical conductor prepared by the process described above.

The foregoing and other features and advantages of the present invention will become more apparent from the following description and accompanying drawings.

BEST MODE FOR CARRYING OUT THE INVENTION

The multi-layer insulation system of the present invention possesses or demonstrates a combination of characteristics or properties not found in conventional insulating materials. This unique combination of desirable properties make the inventive insulated conductor most valuable in applications such as aircraft, missiles, satellites, etc.

As will be described in more detail below, the high degree of high temperature adhesive bond strength demonstrated by the inner layer of a preferred embodiment of the present invention has been found to be particularly surprising.

Figure 1:
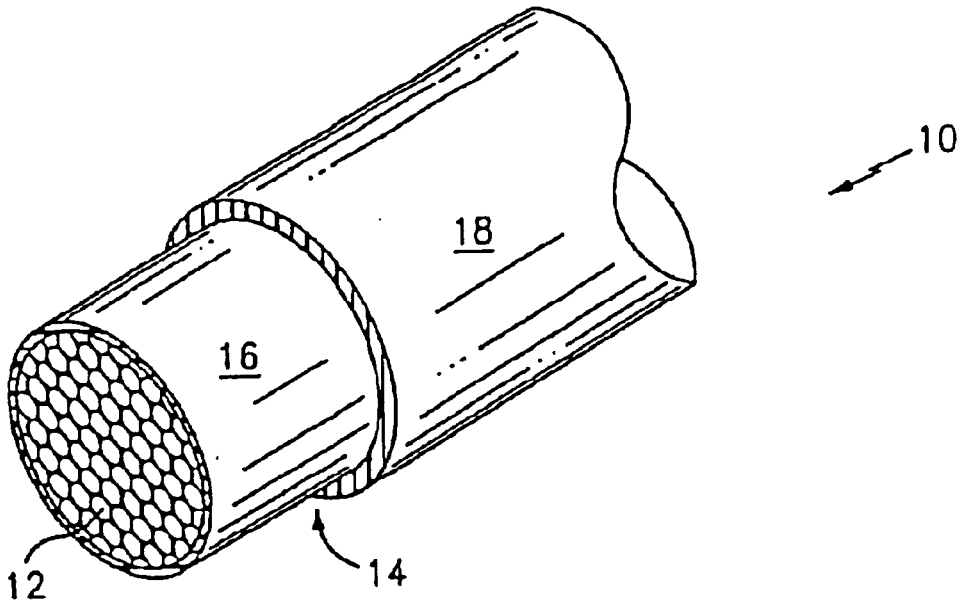
FIG. 1 is an elevational side view of a stranded cable insulated with a preferred embodiment of the multi-layer insulation system of the present invention, having the outer insulating layer cut away for purposes of illustration.

Referring now to FIG. 1 in detail, reference numeral 10 has been used to generally designate a preferred embodiment of the insulated electrical conductor of the present invention. Insulated electrical conductor 10 basically comprises an electrical conductor 12, which is insulated with a multi-layer insulation system 14 comprising:

(1) a polyimide film inner layer 16;

wherein the polyimide film inner layer 16 is formed by wrapping the film, which has been coated with a sealable component, in an overlapping fashion, along a portion or length of the electrical conductor 12, wherein the polyimide film is substantially uniformly sealed to itself in overlapping regions along the length of the conductor 12, thereby forming an effective seal against moisture, and wherein the sealable component comprises a perfluoropolymer, a crosslinked fluoropolymer, or a polyimide adhesive; and (2) an extruded, crosslinked fluoropolymer outer layer 18.

The electrical conductor 12 of the present invention may take various forms (e.g., metal wire, stranded cable), and may be prepared using any suitable conductive material including copper, copper alloys, nickel, nickel-clad copper, nickel-plated copper, tin, silver, and silver-plated copper. In a preferred embodiment, the electrical conductor is in the form of a stranded cable, and is prepared using copper or nickel-plated copper.

Any film-forming polyimide may be used in the practice of the present invention, with preferred polyimides being aromatic polyimide films. In a more preferred embodiment, the polyimide film is a polyimide copolymer film derived from the reaction of an aromatic tetracarboxylic acid dianhydride component comprising from 0 to 95 mole %, preferably from 10 to 95 mole %, of 3,3',4,4'-biphenyltetracarboxylic dianhydride and from 5 to 100 mole %, preferably from 5 to 90 mole %, of pyromellitic dianhydride, and an aromatic diamine component comprising from 25 to 99 mole %, preferably from 40 to 98 mole %, of p-phenylene diamine and from 1 to 75 mole %, preferably from 2 to 60 mole %, of a diaminodiphenyl ether such as 4,4'-diaminodiphenyl ether, 3,3'-diaminodiphenyl ether or 3,4'-diaminodiphenyl ether. Such films are described in U.S. Pat. No. 5,731,088 to Philip R. La Court, which is incorporated herein by reference.

Polyimide films suitable for use in inner layer 16 of the present invention are films having a sealable component (i.e., a heat-sealable adhesive) coated or laminated on/to at least one surface. It is noted that such films are typically purchased with at least one surface coated with a heat-sealable adhesive, where the coating or lamination of such films constitutes a highly specialized area of practice undertaken by only a limited number of companies.

Heat-sealable adhesives which may be used in the present invention include perfluoropolymer, crosslinkable fluoropolymer, and polyimide adhesives.

Perfluoropolymer adhesives, suitable for use in the present invention, include PTFE, FEP, PFA, and copolymers of tetrafluoroethylene and perfluoromethylvinylether (MFA) adhesives, while suitable crosslinkable fluoropolymer adhesives include ETFE and chlorotrifluoroethylene (CTFE) copolymer and terpolymer adhesives which contain minor amounts of one or more fluorinated comonomers (e.g., HFP, HFIB, PFBE, VDF and VF).

Polyimide adhesives, suitable for use in the present invention, include thermoplastic polyimide adhesives, which soften and become fluid at or above 200° C.

Preferred heat-sealable films are polyimide films coated or laminated with a heat-sealable polyimide adhesive. Such materials are available from E.I. DuPont de Nemours and Company ("DuPont"), Wilmington, Del., under the trade designation KAPTON HKJ, KAPTON EKJ, and ELJ heat-sealable polyimide films.

The heat-sealable films are preferably applied to an electrical conductor 12 in tape form, by either spirally or axially wrapping the tape about the conductor 12.

Figure 2:
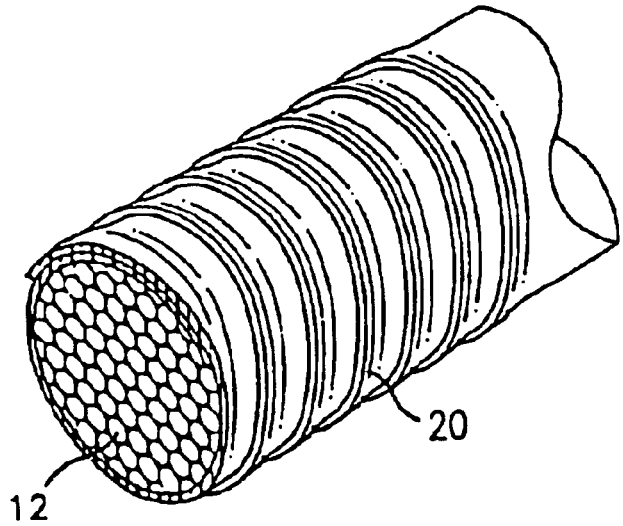
FIG. 2 is an elevational side view of a stranded cable spiral-wrapped with a polyimide film or tape prior to undergoing a heat-sealing operation.

For spiral-wrap applications, the tape preferably has a width ranging from about 0.30 to about 0.95 centimeters (cm), and a thickness ranging from about 0.01 to about 0.04 millimeters (mm). As best shown in FIG. 2, which depicts electrical conductor 12 spiral-wrapped with a polyimide tape 20 prior to undergoing a heat-sealing operation, the tape 20 is preferably wrapped so as to achieve a degree of overlap ranging from about 10 to about 70%.

Figure 3:
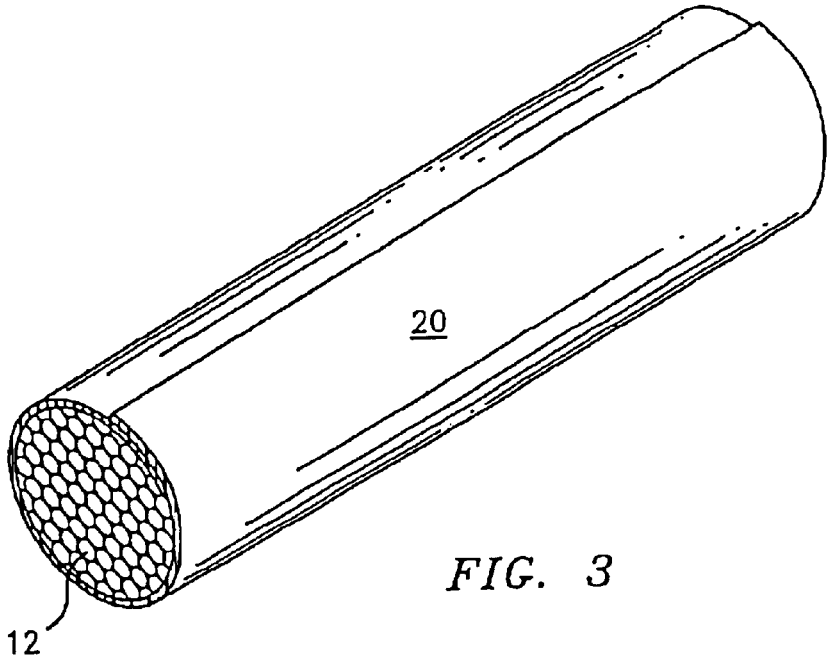
FIG. 3 is an elevational side view of a stranded cable axially-wrapped with a polyimide film or tape prior to undergoing a heat-sealing operation.

In regard to axial-wrap applications for typical aircraft wire, the tape 20 preferably has a width ranging from about 0.15 to about 0.50 cm, and a thickness ranging from about 0.01 to about 0.04 mm. For much larger conductors, such as main power lines in aircraft, the tape 20 preferably has a width of from about 115 to about 150% of the conductor circumference, and a thickness ranging from about 0.01 to about 0.04 mm. As best shown in FIG. 3, which depicts the conductor 12 axially-wrapped with the polyimide tape 20 prior to undergoing a heat-sealing operation, the tape 20 is preferably wrapped so as to achieve a degree of overlap ranging from about 15 to about 50%.

After the tape 20 is applied to the conductor 12, the resulting assembly is heated to a temperature ranging from about 240 to about 350° C., preferably from about 260 to about 280° C. The purpose of the heating operation is to bond or fuse the overlapping regions of the polyimide tape 20, thereby forming an effective seal against moisture along the length of the conductor 12. As a result, the electrical integrity of the conductor 12 will be preserved.

The thickness of the inner layer 16 of the insulated electrical conductor 10 of the present invention preferably ranges from about 0.01 to about 0.08 mm, and more preferably ranges from about 0.02 to about 0.05 mm.

Inner layer 16 demonstrates a high temperature (i.e., 150° C.) adhesive bond strength ranging from about 100 to about 250 grams per inch-width (gm/inch-width). When inner layer 16 is prepared using a polyimide film coated or laminated with a heat-sealable polyimide adhesive, it demonstrates a high temperature (i.e., 150° C.) adhesive bond strength of greater than 1000 gm/inch-width, preferably greater than 1500 gm/inch-width. Such adhesive bond strengths are considerably higher than those demonstrated by prior art heat-sealed wire insulations. High temperature adhesive bond strength is measured in accordance with ASTM# 1876-00—Standard Test Method for Peel Resistance of Adhesives (T-Peel Test).

As referenced above, the high degree of high temperature adhesive bond strength demonstrated by inner layer 16, when prepared using the preferred heat-sealable films, has been found to be particularly surprising.

Fluoropolymers which may advantageously be utilized in the outer layer 18 of the insulated electrical conductor 10 of the present invention include, for example, copolymers and terpolymers of ethylene-tetrafluoroethylene (ETFE), and mixtures thereof.

It is noted that extruded fluoropolymer outer layers change color as a result of thermal aging. Where polyimides demonstrate greater thermal stability than fluoropolymers, the noted color change in the outer layer can serve as an early warning signal that the insulated electrical conductor will need to be replaced. This feature is extremely valuable in aircraft wire and cable applications.

In a preferred embodiment, the fluoropolymer of outer layer 18 is an ETFE copolymer which comprises 35 to 60 mole % (preferably 40 to 50 mole %) of units derived from ethylene, 35 to 60 mole % (preferably 50 to 55 mole %) of units derived from tetrafluoroethylene and up to 10 mole % (preferably 2 mole %) of units derived from one or more fluorinated comonomers (e.g., HFP, HFIB, PFBE, VDF and VF). Such copolymers are available from DuPont under the trade designation TEFZEL HT 200, and from Daikin America, Inc. ("Daikin"), Orangeburg, N.Y., under the trade designation NEOFLON EP-541.

The fluoropolymer(s) preferably contains (as extruded) from about 4 to about 16% by weight of a crosslinking agent. Preferred crosslinking agents are radiation crosslinking agents that contain multiple carbon-carbon double bonds.

In a more preferred embodiment, crosslinking agents containing at least two allyl groups and more preferably, three or four allyl groups, are employed. Particularly preferred crosslinking agents are triallyl isocyanurate (TAIC), triallylcyanurate (TAC) and trimethallylisocyanurate (TMAIC).

In yet a more preferred embodiment, the fluoropolymer(s) contains a photosensitive substance (e.g., titanium dioxide), which renders the outer layer 18 receptive to laser marking. The term "laser marking," as used herein, is intended to mean a method of marking an insulated conductor using an intense source of ultraviolet or visible radiation, preferably a laser source. In accordance with this method, exposure of the fluoropolymer outer layer 18 to such intense radiation will result in a darkening where the radiation was incident. By controlling the pattern of incidence, marks such as letters and numbers can be formed.

In yet a more preferred embodiment, the fluoropolymer(s) contains from about 1 to about 4% by weight, of titanium dioxide.

In addition to the above component(s), the fluoropolymer(s) may advantageously contain other additives such as pigments (e.g., titanium oxide), lubricants (e.g., PTFE powder), antioxidants, stabilizers, flame retardants (e.g., antimony oxide), fibers, mineral fibers, dyes, plasticizers and the like. However, some such additives may have an adverse effect on the desirable properties of the insulated electrical conductor of the present invention.

The components of the outer layer may be blended together by any conventional process until a uniform mix is obtained. In a preferred embodiment, a twin-screw extruder is used for compounding. The outer layer 18 is preferably formed by melt-extrusion, and then crosslinked using either known techniques, which include beta and gamma radiation crosslinking methods, or "skin irradiation" techniques. "Skin irradiation" techniques are described in more detail below.

The thickness of the outer layer 18 of the insulated electrical conductor 10 of the present invention preferably ranges from about 0.05 to about 0.25 mm, and more preferably ranges from about 0.10 to about 0.13 mm.

Figure 4:
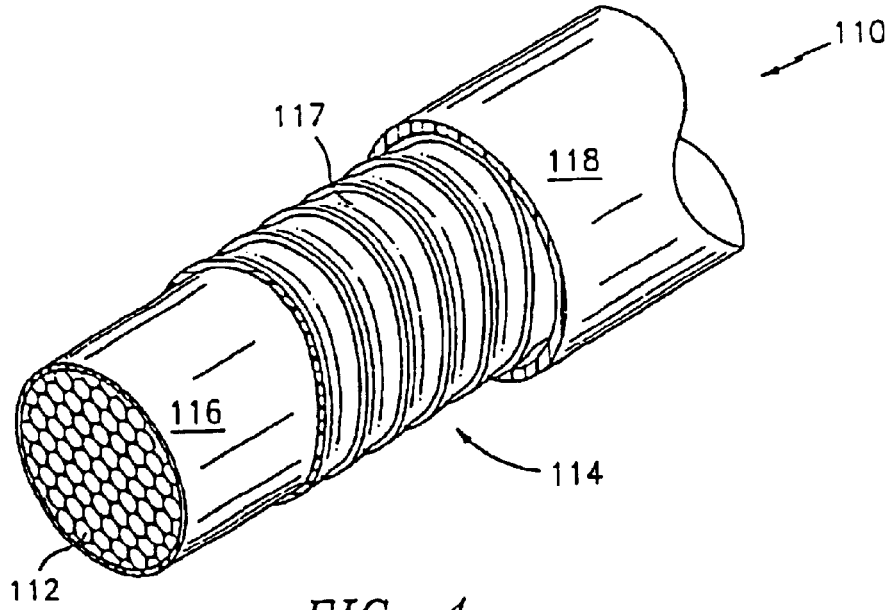
FIG. 4 is an elevational side view of a stranded cable insulated with a more preferred embodiment of the multi-layer insulation system of the present invention, having middle and outer insulating layers cut away for purposes of illustration.

Referring now to FIG. 4 in detail, reference numeral 110 has been used to generally designate a more preferred embodiment of the insulated electrical conductor of the present invention. In this more preferred embodiment, insulated electrical conductor 110 demonstrates improved flexibility, and comprises an electrical conductor 112, which is insulated with a multi-layer insulation system 114 comprising:

(1) a fluoropolymer inner layer 116, wherein the fluoropolymer inner layer 116 is formed by either extruding a fluoropolymer material along a portion or length of the electrical conductor 112, or wrapping a fluoropolymer film, in an overlapping fashion, along the length of the conductor 112, (2) a polyimide film middle layer 117, wherein the polyimide middle layer 117 is formed by wrapping an optionally coated polyimide film, in an overlapping fashion, along a portion or length of the inner layer 116; and (3) an extruded, crosslinked fluoropolymer outer layer 118.

Fluoropolymers which may advantageously be utilized in the inner layer 116 of the insulated electrical conductor 110 of the present invention include, for example, MFA, PFA, PTFE, ethylene-chlorotrifluoroethylene (ECTFE) copolymers, ethylene-tetrafluoroethylene (ETFE) copolymers, polyvinylidene fluoride (PVDF), tetrafluoroethylene-hexafluoropropylene-vinylidene fluoride (THV), polyvinylfluoride (PVF) resins, and mixtures thereof.

In a preferred embodiment, inner layer 116 is extruded and the fluoropolymer comprises a copolymer or terpolymer of ETFE. In a more preferred embodiment, the polymer is an ETFE terpolymer that has been compounded with a TAIC crosslinking agent. Such polymers are available from DuPont and Daikin, under the product designations TEFZEL HT200 fluoropolymer resin and NEOFLON EP-541 fluoropolymer resin, respectively.

In yet a more preferred embodiment, inner layer 116 is extruded and crosslinked and the extruded fluoropolymer material of inner layer 116 is substantially the same as the material used to prepare outer layer 118, but contains less crosslinking agent.

In another preferred embodiment, inner layer 116 is wrapped and the fluoropolymer is PTFE tape. In a more preferred embodiment, the PTFE is in the form of a skived tape, with such tapes being available from Goodrich Corporation, Four Coliseum Centre, 2730 West Tyvola Road, Charlotte, N.C. 28217-4578, under the product designation PTFE Skived Tapes.

The fluoropolymer film inner layer 116 may be a heat-sealed or a non-heat-sealed fluoropolymer film inner layer. It is noted that wrapped fluoropolymer tapes or films will fuse or bond to themselves in overlapping regions at temperatures at or above the melting point of the fluoropolymer, thereby obviating the need to employ a heat-sealable adhesive with such films.

The polyimide film of middle layer 117 is preferably applied to inner layer 116 in tape form, by spirally wrapping the tape about inner layer 116, so as to achieve a degree of overlap ranging from about 10 to about 70%. In one embodiment, the polyimide film of middle layer 117 does not employ a heat-sealable adhesive and is not heat-sealed. In another embodiment, the polyimide film employs a heat-sealable adhesive and is substantially uniformly sealed to itself in over-lapping regions along the length of inner layer 116. In one such embodiment, inner layer 116 is formed using a fluoropolymer tape and the fluoropolymer tape is heated together with the coated polyimide film, but is not sealed.

Preferred non-heat-sealable polyimide films have a thickness ranging from about 0.01 to about 0.04 mm, and are available from DuPont, under the trade designation KAPTON H and KAPTON E polyimide films. Preferred heat-sealable polyimide films are the same as those noted above for inner layer 16.

The preferred insulated electrical conductor 110 described above, which employs a non-heat-sealed polyimide film middle layer, demonstrates a degree of flex which is substantially greater than prior art wire constructions. The degree of flex or wire flexibility is measured by: selecting a 0.9 meter section of insulated wire (i.e., an insulated stranded nickel plated copper conductor (20 American Wire Gage (AWG), 19 Strand, nickel plated copper) measuring 0.95 mm in diameter), which is substantially free of kinks and bends; attaching a ring connector to each end of the conductor; attaching a 100 gram weight to each ring connector; carefully suspending the insulated wire on a stationary mandrel having a diameter measuring 0.48 cm; waiting one minute; and measuring the width between parallel insulated wire segments at three different points along the length of the wire. The degree of flex or wire flexibility is an average of the three width measurements.

In a most preferred embodiment, insulated electrical conductor 110 comprises an electrical conductor 112, which is insulated with a multi-layer insulation system 114 comprising: (1) an extruded, crosslinked ETFE inner layer 116; (2) a non-heat-sealed polyimide film middle layer 117; and (3) an extruded, crosslinked ETFE outer layer 118.

In another most preferred embodiment, insulated electrical conductor 110 comprises an electrical conductor 112, which is insulated with a multi-layer insulation system 114 comprising: (1) a non-heat-sealed PTFE inner layer 116; (2) a heat-sealed polyimide film middle layer 117; and (3) an extruded, crosslinked ETFE outer layer 118.

It is noted that although the present inventive insulated electrical conductor 10, 110 has been described hereinabove as an insulated stranded cable, it is not so limited. The insulated conductor 10, 110 may comprise a single wire covered with the multi-layer insulation system 14, 114 of the present invention, or may comprise a plurality of bunched, twisted, or bundled wires, with each wire separately covered with the multi-layer insulation system 14, 114. The insulated conductor 10, 110 may also comprise a plurality of single or dual layer insulated wires which are coated with the polyimide or fluoropolymer inner layer 16, 116 and optionally, with the polyimide film middle layer 117. In this embodiment, the plurality of single or dual layer insulated wires are covered with a sheath consisting of the crosslinked fluoropolymer outer layer 18, 118.

The process for preparing the insulated electrical conductor 10, 110 of the present invention basically comprises:

(a) forming a polyimide or fluoropolymer inner layer 16, 116 on an electrical conductor 12, 112, wherein, when the inner layer is a polyimide inner layer, the layer 16, 116 is formed by wrapping a polyimide film, which has been coated with a sealable component, in an overlapping fashion, along a portion or length of the electrical conductor 12, 112, wherein the sealable component comprises a perfluoropolymer, a crosslinked fluoropolymer, or a polyimide adhesive, wherein, when the inner layer is a fluoropolymer inner layer, the layer 16, 116 is formed by either: i) extruding a fluoropolymer material along a portion or length of the electrical conductor 12, 112, or ii) wrapping a fluoropolymer film, in an overlapping fashion, along a portion or length of the electrical conductor 12, 112, (b) optionally, forming a polyimide middle layer 117 on the polyimide or fluoropolymer inner layer 16, 116 by wrapping an optionally coated polyimide film, in an overlapping fashion, along a portion or length of the inner layer 16, 116, (c) when the inner layer 16, 116 is a polyimide inner layer or when a middle layer 117 is formed using a coated polyimide film, heating the polyimide film or films to a temperature ranging from about 240° to about 350° C. to cause overlapping regions of the coated film or films to bond, thereby forming an effective seal against moisture along the length of the conductor 12, 112, (d) forming a fluoropolymer outer layer 18, 118 on either the inner or middle layer 16, 116, 117 by extruding a fluoropolymer material along a portion or length of that layer; and (e) crosslinking the fluoropolymer outer layer 18, 118, wherein, when the inner layer 16, 116 or the sealable component comprises a perfluoropolymer (e.g., polytetrafluoroethylene, fluorinated ethylene propylene copolymers, perfluoroalkoxy resins), the fluoropolymer outer layer 18, 118 is crosslinked by exposing it to less than 60 megarads of radiation, with applied voltages ranging from about 50 to about 120 kilo volts, wherein, when the inner layer 16, 116 is a fluoropolymer inner layer, the process for preparing an insulated, electrical conductor includes forming a polyimide middle layer 117 on the polyimide or fluoropolymer inner layer 16, 116.

Insulated electrical conductors 10, 110 that do not employ perfluoropolymers are preferably subjected to an irradiation step to effect crosslinking in the fluoropolymer outer layer 18, 118. In a more preferred embodiment, the dosage of ionizing radiation (e.g., accelerated electrons or gamma rays) employed in the irradiation step is below 50 megarads (Mrads), more preferably, between 5 and 25 Mrads and, most preferably, between 15 and 25 Mrads, while applied voltages range from about 0.25 to about 3.0 mega volts (MV), and preferably range from about 0.5 to about 1.0 MV. The irradiation step is preferably carried out at ambient temperature.

Insulated electrical conductors 10, 110, which employ an inner layer or sealable component comprising a perfluoropolymer are subjected to a so-called "skin irradiation" process to effect crosslinking in the fluoropolymer outer layer 18, 118. The subject process employs ionizing radiation in the form of accelerated electrons, and basically comprises using an accelerated voltage such that the maximum attained distance of accelerated charged particles is less than or equal to the thickness of the outer layer 18, 118. More specifically, with an applied voltage of 120 KV, most electrons will penetrate outer layer 18, 118 to a maximum depth of approximately 0.13 mm.

Such a technique or process is briefly described in JP 4-52570 in regard to automotive low voltage wire coated with e.g. a soft vinyl chloride resin. JP 4-52570 is incorporated herein by reference.

In a preferred embodiment, the dosage of ionizing radiation (i.e., accelerated electrons) employed in the irradiation step is below 60 Mrads, more preferably, between 20 and 50 Mrads and, most preferably, between 30 and 40 Mrads, while applied voltages range from about 50 to about 120 kilo volts (KV), and preferably range from about 100 to about 120 KV. The "skin irradiation" technique or process is preferably carried out at ambient temperature.

It is noted that in the "skin irradiation" technique described above, where electrons do not reach the conductor during electron beam irradiation, electrons may accumulate in the insulation thereby increasing the possibility of flooding and/or channeling. As will be readily appreciated by those skilled in the art, electron flooding and channeling may damage the insulation by causing the formation of tiny pin-holes.

The present inventors have discovered that by exposing "skin irradiated" insulated electrical conductor 10, 110 to elevated temperatures ranging from about 150 to about 220° C., accumulated electrons may be more effectively drained off without damaging the insulation.

The insulated electrical conductor 10, 110 of the present invention is lightweight, and may be used in environments where temperatures may exceed 230° C. In addition, the inventive conductor 10, 110 demonstrates mechanical durability and resistance to hydrolysis.

Preferably, insulated conductor 10, 110 weighs from about 1.9 to about 2.0 kilograms (kg) per 305 meters (m), which serves to satisfy the maximum weight limits set forth in the following Military Specifications—M22759/92-20, M22759/86-20, M22759/32-20, and M22759/34-20.

The 230° C. temperature rating of insulated electrical conductor 10, 110 was determined in accordance with Military Specification MIL-DTL-22759/87A—Accelerated Aging Test. This test, which requires aging wire samples for 500 hours in an air-circulating oven maintained at a temperature of 290° C., was modified to the extent that the oven temperature was reduced to 260° C.

Mechanical durability is evidenced by the ability of insulated electrical conductor 10, 110 to pass the following tests: (1) Wire-to-Wire Abrasion Resistance—Boeing Specification Support Standard BSS 7324 entitled "Procedure for Testing Electrical Wire and Cable" dated Dec. 2, 1998 ("Boeing BSS 7324); (2) Dynamic Cut-Through Resistance (at elevated temperatures of up to 260° C.)—ASTM D 3032, Section 22, and Military Specification MIL-DTL-22759/87A; and (3) Sandpaper Abrasion Resistance—Society of Automotive Engineers (SAE) test method J1128 Section 5.10.

The resistance to hydrolysis demonstrated by insulated electrical conductor 10, 110 was measured in accordance with SAE test method AS4373, Section 4.6.2, Method 602.

In a more preferred embodiment, the multi-layer insulation system and insulated electrical conductor 10, 100 of the present invention demonstrate other desirable properties including excellent resistance to flame, the ability to be marked using ultraviolet or visible radiation, electrical resistance, humidity resistance, low smoke generation, notch propagation resistance, weathering resistance, wet and dry arc track resistance, and resistance to common solvents and other fluids used in the aircraft industry.

The subject invention will now be described by reference to the following illustrative examples. The examples are not, however, intended to limit the generally broad scope of the present invention.

WORKING EXAMPLES
Components Used

In the Working Examples set forth below, the following components and materials were used:

| | |
|---|---|
| CONDUCTOR: | a stranded nickel plated copper conductor (20 American Wire Gage (AWG), 19 Strand, nickel plated copper) measuring 0.95 mm in diameter. |
| POLYIMIDE FILM I: | heat-sealable polyimide film coated or laminated on both sides with a heat-activated, high temperature polyimide adhesive, marketed under the trade designation KAPTON HKJ heat-sealable polyimide film, by DuPont. |
| POLYIMIDE FILM II: | heat-sealable polyimide film coated or laminated on both sides with a heat-activated, high temperature polyimide adhesive, marketed under the trade designation KAPTON EKJ heat-sealable polyimide film, by DuPont. |
| POLYIMIDE FILM III: | heat-sealable polyimide film coated or laminated on both sides with a heat-activated, medium temperature polyimide adhesive, marketed under the trade designation KAPTON ELJ heat-sealable polyimide film, by DuPont. |
| POLYIMIDE FILM IV: | heat-sealable polyimide film coated or laminated on both sides with a heat-activated perfluoropolymer adhesive, marketed under the trade designation KAPTON XP heat-sealable polyimide film, by DuPont. |
| POLYIMIDE FILM V: | heat-sealable polyimide film coated or laminated on both sides with a heat-activated perfluoropolymer adhesive, marketed under the trade designation OASIS TWT561 heat-sealable polyimide film, by DuPont. |
| ETFE: | a copolymer comprising 35 to 60 mole % of ethylene; 60 to 35 mole % of tetrafluoroethylene; and up to 10 mole % of a fluorinated termonomer, marketed under the trade designation TEFZEL HT 200 fluoropolymer resin, by DuPont. Melting point of fluoropolymer resin is approximately 270° C. |
| ETFE(I): | a copolymer comprising 30 to 50 mole % of ethylene; 70 to 50 mole % of tetrafluoroethylene; and up to 10 mole % of a fluorinated termonomer, marketed under the trade designation TEFZEL HT 2127 fluoropolymer resin, by DuPont. Melting point of fluoropolymer resin is approximately 243° C. |
| PTFE: | a skived polytetrafluoroethylene film, marketed under the trade designation TEFLON TFE fluoropolymer resin, by DuPont. |
| TAIC: | a triallyl isocyanurate crosslinking agent, marketed under the designation TAIC triallyl isocyanurate, by Nippon Kasei Chemical Co., Ltd., Tokyo, Japan. |
| $TiO_2$: | titanium dioxide pigment in powder form (≧96% in purity), marketed under the trade designation TIPURE titanium dioxide pigment, by DuPont. |

Sample Preparation

EXAMPLES 1A TO 1E

A continuous strip of POLYIMIDE FILM I, measuring 0.64 cm in width and 0.03 mm in thickness, was spiral-wrapped, at a 53% overlap, about a CONDUCTOR. The spiral-wrapped CONDUCTOR was then heated in a continuous process to a temperature in excess of 300° C. for approximately 5 seconds to heat-seal the overlapping portions of the POLYIMIDE FILM I strip, and was then allowed to cool. The thickness of the heat-sealed, spiral-wrapped POLYIMIDE FILM I inner layer was 0.05 mm.

A quantity of ETFE was compounded with 8% by wt. TAIC and 2% by wt. $TiO_2$ and was then extruded over the POLYIMIDE FILM I inner layer using a single-screw extruder having four heating zones which were set at 200°, 240°, 275°, and 290° C., respectively. The thickness of the extruded ETFE layer was 0.13 mm.

Test samples were then irradiated using electron-beam radiation, with air-cooling. Total beam dosages were 10, 15, 20, or 30 megarads, while applied voltages were either 120 KV, 150 KV, or 0.5 MEV.

The subject wire construction is described in Table 1, hereinbelow.

EXAMPLES 2, 3A TO 3C, 4A AND 4B

Four test samples of the wire construction labeled Example 2, ten test samples of Example 3, and six test samples of Example 4, were prepared substantially in accordance with the method identified above for Example 1, except that test samples for each Example were prepared using a different polyimide film. As above, total beam dosages were 10, 15, 20, or 30 megarads, while applied voltages were either 120 KV, 150 KV, or 0.5 MEV.

The subject wire constructions are more fully described in Table 1, hereinbelow.

EXAMPLE 5

One thousand feet of the wire construction labeled Example 5 were repared substantially in accordance with the method identified above for Examples 1A to 1E, except that total beam dosage was 18 megarads, while applied voltages were 0.5 mega electron volts.

The subject wire construction is more fully described in Table 1, hereinbelow.

EXAMPLES 6 TO 9

A continuous strip of PTFE, measuring 0.63 cm in width and 0.025 mm in thickness, was spiral-wrapped, at either a 54% overlap (Example 6) or a 15% overlap (Examples 7 to 9), about a CONDUCTOR. A continuous strip of either POLYIMIDE FILM III (Examples 6 and 7), measuring 0.63 cm in width and 0.025 mm in thickness or POLYIMIDE FILM II (Examples 8 and 9), measuring 0.63 cm in width and 0.018 mm in thickness, was then spiral-wrapped, at a 54% overlap, about the spiral-wrapped PTFE inner layer. The spiral-wrapped CONDUCTOR was then heated in a continuous process to a temperature in excess of 300° C. for approximately 5 seconds to heat-seal the overlapping portions of the POLYIMIDE FILM layer, and was then allowed to cool. The thickness of the inner and middle layers was 0.076 mm (Examples 6 and 7) and 0.061 mm (Examples 8 and 9).

A quantity of ETFE or ETFE(I) was compounded with 8% by wt. TAIC and 2% by wt. $TiO_2$ and was then extruded over the POLYIMIDE FILM middle layer using a single-screw extruder having four heating zones which were set at 200°, 240°, 275°, and 290° C., respectively. The thickness of the extruded ETFE or ETFE(I) layers was 0.13 mm (Examples 6 and 7) and 0.14 mm (Examples 8 and 9).

Five hundred feet of each test sample wire construction were then irradiated using electron-beam radiation, with air-cooling. Total beam dosages were 18 megarads for Examples 6 and 7, and 36 megarads for Examples 8 and 9, while applied voltages were 0.5 MEV.

The subject wire constructions are more fully described in Table 1, hereinbelow.

EXAMPLES C-1 AND C-2

Four test samples each of prior art wire constructions C-1 and C-2 were prepared as set forth below.

C-1 was prepared substantially in accordance with the method identified above for Example 1, except that 0.06 mm thick PTFE tape was spiral-wrapped, with a 53% overlap, over a spiral-wrapped POLYIMIDE FILM IV inner layer prior to heat-sealing. The resulting wire construction was then exposed to a temperature in excess of 330° C. to effect heat-sealing in both layers.

C-2 was prepared by compounding ETFE with 1.5% by wt. TAIC, and then by extruding the compounded material over the CONDUCTOR using a single-screw extruder, as described above. A quantity of compounded ETFE material, which had been compounded with 8% by wt. TAIC, was then extruded over the ETFE inner layer, and the resulting wire construction irradiated using electron-beam radiation, with air cooling. Total beam dosage was 30 megarads, with an applied voltage of 0.5 MEV.

The subject prior art wire constructions are more fully described in Table 1, hereinbelow.

TABLE 1

Summary of Examples 1A to 1E, 2, 3A to 3C, 4A, 4B, 5 to 9, C-1 and C-2

| EXAMPLE | 1A, 1B, 1C, 1D, 1E | 2 | 3A, 3B, 3C | 4A, 4B | 5 | 6 | 7 | 8 | 9 | C-1 | C-2 |
|---|---|---|---|---|---|---|---|---|---|---|---|
| Inner Layer | Polyimide Film I | Polyimide Film II | Polyimide Film IV | Polyimide Film V | Polyimide Film I | PTFE | PTFE | PTFE | PTFE | Polyimide Film V | ETFE |
| Adhesive | PI[1] | PI | FP[2] | FP | PI | — | — | — | — | FP | N/A |
| Thickness of Inner Layer (mm) | 0 05 | 0.08 | 0 08 | 0 06 | 0 05 | 0 03 | 0 03 | 0 03 | 0 03 | 0 06 | 0 09 |
| Middle Layer | — | — | — | — | — | Polyimide Film III | Polyimide Film III | Polyimide Film II | Polyimide Film II | — | — |
| Adhesive | — | — | — | — | — | PI | PI | PI | PI | — | — |
| Thickness of Middle Layer (mm) | — | — | — | — | — | 0 05 | 0 05 | 0 04 | 0 04 | — | — |
| Outer Layer | ETFE | ETFE | ETFE | ETFE | ETFE | ETFE | ETFE | ETFE (I) | ETFE | PTFE | ETFE |
| Thickness of Outer Layer (mm) | 0.13 | 0 13 | 0 13 | 0 13 | 0 13 | 0.13 | 0 13 | 0 13 | 0.13 | 0 13 | 0 13 |
| Total Insulation Thickness (mm) | 0 20 | 0.20 | 0 20 | 0 20 | 0 20 | 0 21 | 0 20 | 0 20 | 0 21 | 0 20 | 0 20 |
| Total Weight of Insulated Wire (gms/m) | 6 50 | 6 69 | 6 37 | 6 40 | 6 50 | 6 69 | 6 62 | 6 46 | 6 71 | 6 89 | 6 60 |

TABLE 1-continued

Summary of Examples 1A to 1E, 2, 3A to 3C, 4A, 4B, 5 to 9, C-1 and C-2

| EXAMPLE | 1A, 1B, 1C, 1D, 1E | 2 | 3A, 3B, 3C | 4A, 4B | 5 | 6 | 7 | 8 | 9 | C-1 | C-2 |
|---|---|---|---|---|---|---|---|---|---|---|---|

[1]PI = polyimide adhesive
[2]FP = perfluoropolymer adhesive

The prepared test samples were then subjected to the test procedures identified below. Test procedures, with the exception of ease of peel, are fully described in the following publications: (1) Boeing Specification Support Standard BSS 7324 entitled "Procedure for Testing Electrical Wire and Cable" dated Dec. 2, 1998 ("Boeing BSS 7324"); (2) Military Specification MIL-DTL-22759/87A entitled "Wire, Electrical, Polytetrafluoroethylene/Polyimide Insulated, Normal Weight, Nickel Coated Copper Conductor, 260° C., 600 Volts," and dated Feb. 23, 1998; (3) Military Specification MIL-STD-2223 entitled "Test Methods for Insulated Electrical Wire," and dated Aug. 31, 1992; (4) Society of Automotive Engineers (SAE) test method AS4374 entitled "Test Methods for Insulated Electrical Wire," and dated August, 1994; and (5) SAE test method J1128 entitled "Surface Vehicle Standard, Low Tension Primary Cable," and dated May, 2000, all of which are incorporated herein by reference.

| Test Methods | |
|---|---|
| Accelerated Aging or Shrinkage Resistance (P, F): | Boeing BSS 7324, paragraph no. 7.1a, pp. 12 to 14, conducted at 280° C. |
| Current Overload Capacity: | Boeing BSS 7324, paragraph no. 7.16, pp. 48 to 50, conducted at room temperature.<br>The insulated wire test samples were evaluated for current overload capacity by removing 13 mm of insulation from wire samples measuring 1.5 m in length. The samples were then suspended horizontally in a test set-up with no visible sag. Then, 33 amperes (amps) of current was applied to each test sample for a period of 5 minutes and the samples cooled to room temperature. Each test sample was visually inspected during current application and after the samples were returned to room temperature. The test samples were then subjected to the dry dielectric test that is described in the Boeing BSS 7324 Specification. The test, which was repeated six times, was deemed passed if at least five out of the six samples passed the test. |
| Cut-Through Resistance (lbs): | MIL-DTL-22759/87<br>Boeing BSS 7324, paragraph no. 7.23, p. 58, Dynamic Cut-Through<br>The insulated wire samples were tested for cut-through resistance using the method described below. The cut-through test measured the resistance of the wire insulation to the penetration of a cutting surface and simulated the type of damage that can occur when a wire is forced by mechanical loading against a sharp edge. The test was performed at room temperature (23° C.), at 150° C., at 200° C., and at 260° C., to evaluate the effect of the elevated temperature on insulation performance. The standard cutting edge used was stainless steel and had a radius of 0.406 mm.<br>For each test, a 600 mm (in length) test sample was clamped in place between a blade and a flat plate within an INSTRON compression tester, and the ends of the conductor connected to an 18 VDC electrical circuit. The cutting edge of the blade was oriented perpendicularly to the axis of the sample. The cutting edge was then forced through the insulation at a constant rate of 1.27 mm per minute until contact with the conductor occurred. A detection circuit sensed contact of the cutting edge with the conductor and recorded the maximum force, encountered during the test. The test was then repeated four times rotating the sample between tests to offset the effect of eccentric insulation. The reported cut-through resistance was the arithmetic mean of five tests performed on each sample. |
| Dry Arc Propagation Resistance (P, F, or number of wires passed): | MIL-STD-2223 Method 3007.<br>Boeing BSS 7324, paragraph no. 7.4, pp. 16 to 30, conducted at room temperature.<br>The insulated wire samples were tested for dry arc propagation resistance using the method described below. Each test sample was cut into 7 pieces, with each piece measuring 35 cm in length. The insulation from five of the seven pieces was stripped from the ends of each piece exposing about 5 mm of |

-continued

| Test Methods | |
|---|---|
| | conductor and the pieces designated "active wires." The insulation from the remaining two wires was left intact and the pieces designated "passive wires."<br>The seven wire pieces were then bundled such that one active wire was located in the center of the bundle while the remaining six wire pieces surrounded the central active wire. The two passive wires were located side-by-side within the bundle. The seven-wire bundle was laced together at four locations so as to keep all seven wires tightly held together throughout the length of the bundle. The distance between the two central laces was about 2.5 cm, while the distance between the central two laces and the outer two laces was about 1.25 cm.<br>The wire bundle was then placed in a jig similar to that shown in the Boeing BSS 7324 Specification. The two passive wires were located at the bottom of the jig, while the stripped wires were individually connected to an electrical circuit. More specifically, the five active wires were connected to a three phase 400 Hz power source. Then, a knife blade with a 250 gm load was placed on top of the wire bundle perpendicular to each wire and the blade movement initiated. The blade moved back and forth at a speed of 0.75 cycles/second. When the top two wires were shorted out, the system was de-energized. Each wire was exposed to a 1000 volt wet dielectric withstand test to check whether the remaining insulation could withstand such voltage. When the insulation withstood 1000 volts, the voltage was increased to 2500 volts. When the wire withstood 1000 volts, it is considered to have passed the test.<br>This test was deemed passed if: (1) a minimum of 64 wires passed the dielectric test; (2) three wires or less failed the dielectric test in any one bundle; and (3) actual damage to the wire was not more than 3 inches in any test bundle. |
| Ease of Peel: | Test samples employing a dual layer insulation system and measuring 0.9 meter in length were tested for ease of peel by (1) removing the outer insulation layer, (2) manually seizing a leading edge of the inner insulation layer (i.e., polyimide tape), and (3) slowly peeling the tape off of the conductor or wire. The inner insulation layer was deemed "continuously peelable" if the entire width of the tape could be continuously peeled from at least five revolutions of the wire without tearing. |
| Hydrolysis Resistance (P, F): | MIL-DTL-22759/87A and SAE AS4373, Method 602 Test (Unconditioned Wire: AS4373, Section 4.6.2.4.2)<br>Test samples having an insulation thickness of approximately 0.20 mm and measuring approximately 762 mm in length were separately fixed and wound on an 8 mm mandrel and placed in salt solution [5% (m/m) of NaCl in water] contained in a 2 liter beaker. The ends of each wound test sample were positioned outside or above the salt solution in the beaker. The test samples were then allowed to age in the salt solution for from 672 to >10,000 hours at 70° C. ± 2° C. Starting at 672 hours, the test samples were visually inspected and then periodically subjected to the Withstand Voltage Test as described below. The Hydrolysis Test was deemed "passed" if the sample, upon being subjected to the Withstand Voltage Test, did not demonstrate any electrical breakdown.<br>Withstand Voltage Test (P, F): For this test, the ends of each test sample were twisted together to form a loop. The looped test sample was then immersed in the salt solution contained in the beaker. The ends of each test sample were located above the solution. A test voltage of 2.5 kV (rms) was then applied through an electrode between the conductor and the solution for five (5) minutes. |
| Life Cycle (P, F): | MIL-DTL-22759/87A. Five (5) hours at 230 to 290° C. ± 2° C. Dielectric test, 2.5 kV (rms) for five (5) minutes.<br>Test samples were tested for life cycle by aging the samples and then by subjecting the aged samples to the Withstand Voltage Test noted above. The samples were aged by separately fixing the samples on a mandrel having a one-half inch diameter and then placing the mandrel and test samples in an air circulation oven set at 30° C. above the intended temperature rating for the product, for a period of 500 hours. |
| Laser Markability: | Boeing BSS 7324, paragraph no. 7.36, pp. 82 to 83, conducted at room temperature.<br>Test conducted by Spectrum Technologies PLC, Western Avenue, Bridgend CF31 3RT, UK, using a CMS II Contrast Meter. |

-continued

| Test Methods | |
|---|---|
| Sandpaper Abrasion (mm): | SAE J1128, Section 6.10<br>Test samples having an insulation thickness of approximately 0.20 mm and measuring 1,000 mm in length were tested for sandpaper abrasion resistance by removing 25 mm of insulation from one end of each test sample and by horizontally mounting each test sample (taut and without stretching) on a continuous strip of abrasion tape in an apparatus that was built by Glowe-Smith Industrial, Inc. (G.S.I. Model No. CAT-3) in accordance with Military Specification MIL-T-5438 and that was capable of exerting a force on the sample while drawing the abrasion tape under the sample at a fixed rate. For each test, 150J garnet sandpaper (with 10 mm conductive strips perpendicular to the edge of the sandpaper spaced a maximum of every 75 mm) was drawn under the sample at a rate of 1500 ± 75 mm/min while a total force of 2.16 ± 0.05 N was exerted on the test sample. The sandpaper approached and exited each test sample from below at an angle of 29 ± 2° to the axis of the test sample and was supported by a rod 6.9 mm in diameter. The length of sandpaper necessary to expose the core or wire was recorded and the test sample moved approximately 50 mm and rotated clockwise 90°. The above-referenced procedure was repeated for a total of four readings. The mean of the four readings constituted the sandpaper abrasion resistance for the subject test sample.<br>It is noted that since the test samples had very thin insulation, this test had to be stopped frequently to observe failure points. |
| Strippability: | ASTM D3032 Section 27.<br>Boeing BSS 7324, paragraph no. 7.48, pp. 96 to 97, conducted at room temperature.<br>Test samples were tested for strippability by carefully removing 70 mm of insulation from test samples measuring 76 mm in length. The bare conductor portion of the test specimen was then threaded through a loosely fitted hole of a jig so that the unstripped insulation stayed at one side of the jig and the stripped wire at the other. Using an INSTRON Tensile Tester, the bare conductor was pulled while the jig was fixed in place. The force required to pull the remaining 6 mm slug of insulation from the test sample was reported as strip force.<br>This test was deemed passed if the strip force fell within the range of from ¼ to 6 pounds (lbs). |
| Wet Arc Propagation Resistance (P, F, or number of wires passed): | MIL-STD-2223, Method 3006.<br>Boeing BSS 7324, paragraph no. 7.4.6 & 7, pp. 26 to 29, conducted at room temperature<br>Test samples were tested for wet arc propagation resistance by preparing seven test samples measuring 35 cm in length from a 3 m long insulated wire sample. Five of the seven wire segments were stripped at both ends exposing about 5 mm of conductor. These stripped wire segments were designated "active wires." The remaining two wire segments that were not stripped were called "passive wires."<br>The seven wire pieces were then bundled such that one active wire was located in the center of the bundle while the remaining six wire pieces surrounded the central active wire. The two passive wires were located side-by-side within the bundle. The seven-wire bundle was laced together at four locations so as to keep all seven wires tightly held together throughout the length of the bundle. The distance between the two central laces was about 2.5 cm, while the distance between the central two laces and the outer two laces was about 1.25 cm.<br>Two wires located on top of the seven-wire bundle had slits measuring 0.5 to 1.0 mm in width that were perpendicular to the wire axis. The slits were positioned 6 mm apart. The stripped wires were connected to a three phase power source according to the scheme set forth in the Boeing BSS 73244 Specification. The wire bundle was energized and a 5% aqueous salt solution was dripped onto the wire bundle where the two exposed slits were located. The rate of application of the salt solution was 8 to 10 drops per minute. This condition was continued for 8 hours unless the bundle failed by tripping a circuit breaker. After an 8-hour exposure to the dripping salt solution under the energized condition, the wire bundles were taken out. Each wire was initially exposed to a 1000 volt wet dielectric withstand test initially, then 2500 volts. When a wire withstood a 1000 volt wet dielectric withstand test, it passed the test. |

-continued

| Test Methods | |
|---|---|
| | This test was deemed passed if: (1) a minimum of 64 wires passed the dielectric test; (2) three wires or less failed the dielectric test in any one bundle; and (3) actual damage to the wire was not more than 3 inches in any test bundle. |
| Wire-to-wire abrasion resistance (cycles to failure, 6,150,000 cycles minimum): | Boeing BSS 7324, paragraph no. 7.57, p. 108.<br>Test samples were tested for wire-to-wire abrasion resistance in accordance with the following method. One wire test sample measuring approximately 28 cm in length was crossed with another wire sample measuring approximately 40 cm in length at the center of the shorter wire as shown in the Boeing BSS 7324 Specification. One end of one wire specimen was fixed on an upper plate while the other end of the same wire was fixed on a lower plate. One end of the other wire was fixed on the lower plate while the other end of the same wire was loaded with a 1.13 Kg weight. The upper and lower plates were 45 mm apart.<br>The lower plate moved back and forth with a 6.35 mm double amplitude at 10 cycles per second. The fixed member of the wire was connected to a power source so that the cycle counter stopped when the two wire specimens made an electrical contact by wearing out the insulation layer. If the cycle count at the stopping point was greater than 6,150,000, the result was considered passing. |

WORKING EXAMPLE 1A

In this example, the prepared wire constructions or test samples were tested for shrinkage resistance, mechanical durability, hydrolysis resistance, and wet arc track resistance, while confirming the temperature rating of 230° C. The results are set forth in Table 2, hereinbelow.

TABLE 2

Summary of Example 1A

| EXAMPLE | TOTAL BEAM DOSAGE (Mrad) | ELECTRON BEAM VOLTAGE (MV) | LIFE CYCLE (P, F) | ACCELERATED AGING (P, F) | HYDROLYSIS RESISTANCE[1] (P, F) | WET ARC PROPAGATION RESISTANCE (P, F) | WIRE-TO-WIRE ABRASION (6,150,000 cycles minimum) |
|---|---|---|---|---|---|---|---|
| 1A | 30 | 0.5 | P | P | P | P | 42,885,600 |

[1]2000 hour requirement met, test continuing.

As shown in Table 2, the insulated conductor of the present invention may be used at temperatures of up to 230° C., and demonstrates a balance of properties including shrinkage resistance, mechanical durability, hydrolysis resistance, and wet arc propagation resistance.

WORKING EXAMPLES 1B, 2, 3A, C-1 AND C-2

In these examples, the prepared wire constructions or test samples were tested for sandpaper abrasion resistance. The results are reported in Table 3, hereinbelow.

TABLE 3

Summary of Examples 1B, 2, 3A, C-1 and C-2

| EXAMPLE | TOTAL BEAM DOSAGE (Mrad) | ELECTRON BEAM VOLTAGE (MV) | SANDPAPER ABRASION (mm) OUTER LAYER | AVG | BOTH LAYERS | AVG |
|---|---|---|---|---|---|---|
| 1B | 30 | 0.5 | 40 | 42 | 117 | 124 |
| | | | 14 | | 153 | |
| | | | 41 | | 151 | |
| | | | 46 | | 75 | |

TABLE 3-continued

Summary of Examples 1B, 2, 3A, C-1 and C-2

| EXAMPLE | TOTAL BEAM DOSAGE (Mrad) | ELECTRON BEAM VOLTAGE (MV) | SANDPAPER ABRASION (mm) OUTER LAYER | AVG | BOTH LAYERS | AVG |
|---|---|---|---|---|---|---|
| 2 | 30 | 0.5 | 38 | 43 | 229 | 172 |
| | | | 41 | | 158 | |
| | | | 43 | | 153 | |
| | | | 48 | | 146 | |
| 3A | 30 | 0.5 | 37 | 41 | 114 | 142 |
| | | | 40 | | 148 | |
| | | | 41 | | 153 | |
| | | | 46 | | 151 | |
| C-1 | N/A | N/A | 9 | 12 | 117 | 109 |
| | | | 11 | | 153 | |
| | | | 13 | | 79 | |
| | | | 16 | | 85 | |
| C-2 | 30 | 0.5 | 40 | 53 | 164 | 157 |
| | | | 53 | | 151 | |
| | | | 56 | | 153 | |
| | | | 62 | | 158 | |

As shown by Examples 1B, 2, and 3A in Table 3, the insulated conductor of the present invention demonstrated a resistance to sandpaper abrasion which was greatly improved over that demonstrated by the prior art wire construction Example C-1, which employed a PTFE outer layer.

WORKING EXAMPLES 1C, 1D, 1E, 3B, 3C, 4A AND 4B

In these examples, the prepared wire constructions or test samples were tested for ease of peel. The results are shown in Table 4, hereinbelow.

TABLE 4

Summary of Examples 1C, 1D, 1E, 3B, 3C, 4A and 4B

| EXAMPLE | TOTAL BEAM DOSAGE (Mrad) | BEAM VOLTAGE (KV) | EASE OF PEEL |
|---|---|---|---|
| 1C | 10 | 120 | not continuously peelable |
| | 15 | | not continuously peelable |
| | 20 | | not continuously peelable |
| 1D | 10 | 150 | not continuously peelable |
| | 15 | | not continuously peelable |
| | 20 | | not continuously peelable |
| 1E | 30 | 500 | not continuously peelable |
| 3B | 10 | 120 | not continuously peelable |
| | 15 | | not continuously peelable |
| | 20 | | not continuously peelable |
| 3C | 10 | 150 | continuously peelable |
| | 15 | | continuously peelable |
| | 20 | | continuously peelable |
| 4A | 10 | 120 | not continuously peelable |
| | 15 | | not continuously peelable |
| | 20 | | not continuously peelable |

TABLE 4-continued

Summary of Examples 1C, 1D, 1E, 3B, 3C, 4A and 4B

| EXAMPLE | TOTAL BEAM DOSAGE (Mrad) | BEAM VOLTAGE (KV) | EASE OF PEEL |
|---|---|---|---|
| 4B | 10 | 150 | continuously peelable |
| | 15 | | continuously peelable |
| | 20 | | continuously peelable |

Examples 3B and 4A demonstrate that insulated conductors employing irradiation degradable perfluoropolymer adhesives may be successfully prepared using a "skin irradiation" technique which effects crosslinking of the outer layer using low electron beam voltages of less than or equal to 120 KV. As shown in Examples 3C and 4B, exposing these samples to electron voltages of 150 KV appears to degrade the adhesive resulting in a sample where the outer layer is continuously peelable along the length of the test sample.

Examples 1C, 1D and 1E, which employed a polyimide adhesive, were not easily peelable regardless of whether the sample was irradiated at 120, 150 or 500 KV, which indicated that higher electron beam voltages do not serve to degrade the polyimide adhesive.

WORKING EXAMPLES 5 TO 9, C-1 AND C-2

In these examples, the prepared wire constructions or test samples were tested for hydrolysis, sandpaper abrasion, cut-through, wet and dry arc propagation and wire-to-wire abrasion resistance, laser markability, strippability, life cycle and current overload capability. The results are set forth in Table 5, hereinbelow.

TABLE 5

Summary of Examples 5 to 9, C-1 and C-2

| Example | Total Insulation Thickness (mm) | Hydrolysis Resistance (P, F) | Sandpaper Abrasion Resistance (mm) Outer Layer Only | Sandpaper Abrasion Resistance (mm) Whole Insulation | Cut-Through Resistance (lbs) 23° C. | Cut-Through Resistance (lbs) 150° C. | Cut-Through Resistance (lbs) 200° C. | Cut-Through Resistance (lbs) 260° C. |
|---|---|---|---|---|---|---|---|---|
| 5 | 0 200 | P | 40 | 172 | 89.0 | 73 9 | 53 9 | 66 2 |
| 6 | 0 210 | P | 45 | 182 | 95 7 | 64 0 | 54.0 | 51 3 |
| 7 | 0 198 | P | 41 | 192 | 89 6 | 52.7 | 50 2 | 46 7 |
| 8 | 0 198 | P[1] | 28 | 77 | 80 0 | 75 0 | 64 0 | 54 0 |
| 9 | 0 210 | P[1] | 22 | 74 | 79 0 | 67 0 | 60 0 | 52 0 |
| C-1 | 0 203 | P | 5 | 116 | 45 | 54 | 42 | 30 |
| C-2 | 0 203 | P | 55 | 156 | 35 | 5 5 | — | — |

| Example | Total Insulation Thickness (mm) | Wet Arc Propagation Resistance (# of bundles, # of wires passed) # of bundles tested | # of bundles passed | # of wires tested | # of wires passed | Dry Arc Propagation Resistance (# of bundles, # of wires passed) # of bundles tested | # of bundles passed | # of wires tested | # of wires passed |
|---|---|---|---|---|---|---|---|---|---|
| 5 | 0 200 | 15 | 12 | 75 | 60 | — | — | 25 | 21 |
| 6 | 0 210 | 15 | 15 | 75 | 75 | 15 | 15 | 75 | 71 |
| 7 | 0 198 | 15 | 15 | 75 | 75 | 15 | 15 | 75 | 69 |
| 8 | 0 198 | — | — | — | — | 15 | 15 | 75 | 68 |
| 9 | 0 210 | 15 | 15 | 75 | 75 | — | — | — | — |
| C-1 | 0 203 | 15 | 15 | 75 | 73 | 15 | 15 | 75 | 74 |
| C-2 | 0 203 | 15 | 15 | 75 | 74 | 15 | 15 | 71 | 71 |

| Example | Total Insulation Thickness (mm) | Laser Markability or Marking Contrast (%) | Strippability (lbs. of strip force) | Wire-To-Wire Abrasion Resistance (6,150,000 minimum) | Life Cycle (# of wires passed) Aging Temperature ° C. | # of Wires Tested | # of Wires Passed | Current Overload Capacity (P, F) |
|---|---|---|---|---|---|---|---|---|
| 5 | 0.200 | — | 3.76 | 42,885,600 | 230 | 3 | 3 | P |
| | | | | | 260 | 3 | 3 | |
| 6 | 0.210 | — | 0.63 | — | 230 | 3 | 3 | P |
| | | | | | 260 | 3 | 0 | |
| 7 | 0.198 | — | 1.15 | 23,600,000 | 230 | 3 | 3 | P |
| | | | | | 260 | 3 | 0 | |
| 8 | 0.198 | 74 | 0.38 | 22,775,000 | 230 | 3 | 3 | P |
| | | | | | 260 | 3 | 2 | |
| 9 | 0.210 | 74 | 0.39 | — | 230 | 3 | 3 | P |
| | | | | | 260 | 3 | 0 | |
| C-1 | 0.203 | 63 | — | >6,150,000 | 230 | 3 | 3 | P |
| C-2 | 0.203 | — | — | >6,150,000 | 290 | 3 | 3 | P |

[1]test continuing, expect to pass

As shown in Table 5, the insulated conductors of the present invention demonstrate a balance of properties including mechanical durability and hydrolysis resistance. More specifically, Examples 5 to 7 demonstrated good hydrolysis resistance, with Examples 8 and 9 noted as currently being tested but expected to demonstrate the same level of resistance. With regard to sandpaper abrasion resistance, Examples 5 to 7 performed similar to Comparative Example C-2. Examples 8 to 9 showed a slight drop-off in this property, while Comparative Example C-1 performed poorly presumably due to the nature of the PTFE outer layer. In terms of cut-through and wire-to-wire abrasion resistance properties, the insulated conductors of the present invention demonstrated greatly improved cut-through resistance over Comparative Examples C-1 and C-2, at all of the temperatures tested, while Examples 5, 7 and 8 demonstrated remarkable levels of wire-to-wire abrasion resistance. With regard to wet arc propagation resistance, Examples 6, 7 and 9 passed each test, while Example 5 passed a majority of the tests. Similar results were obtained for dry arc propagation resistance, with each Example passing all, or a majority of, the tests. In addition, Examples 8 and 9 both demonstrated improved laser markability over Comparative Example C-1, while all of the inventive insulated conductors successfully passed the industry standard for strippability, namely—a strip force of from ¼ to 6 lbs. With regard to life cycle and temperature ratings, Example 8 qualified for a temperature rating of 230° C. Finally, all of the test samples satisfied the requirements for threshold current overload capacity.

Although the present invention has been shown and described with respect to detailed embodiments thereof, it will be understood by those skilled in the art that various changes in form and detail thereof may be made without departing from the spirit and scope of the claimed invention.

Having thus described the invention, what is claimed is:

1. A multi-layer insulation system for electrical conductors, which comprises:

(a) a polyimide inner layer, wherein, the polyimide inner layer is formed by wrapping a polyimide film, which has been coated with a sealable component, in an overlapping fashion, along a portion or length of an electrical conductor, wherein, the polyimide film is substantially uniformly sealed to itself in overlapping regions along the length of the conductor, thereby forming an effective seal against moisture, wherein, the sealable component is selected from the group of perfluoropolymer, crosslinked fluoropolymer and polyimide adhesives, (b) a polyimide middle layer, wherein the polyimide middle layer is formed by wrapping an optionally coated polyimide film, in an overlapping fashion, along a portion or length of the inner layer formed on the electrical conductor, and (c) an extruded, crosslinked fluoropolymer outer layer, wherein the fluoropolymer is selected from the group of copolymers and terpolymers of ethylene-tetrafluoroethylene, and mixtures thereof.

2. The multi-layer insulation system of claim 1 wherein the sealable component coated onto the polyimide film is a polyimide sealable component selected from the group of thermoplastic polyimides which soften and become fluid at greater than or equal to 200° C.

3. The multi-layer insulation system of claim 2, wherein the polyimide inner layer demonstrates a high temperature (greater than or eaual to 150° C.) adhesive bond strength (ASTM# 1876-00) of greater than 1000 grams per inch-width.

4. The multi-layer insulation system of claim 1 wherein the sealable component coated onto the polyimide film is a perfluoropolymer sealable component selected from the group of polytetrafluoroethylene, fluorinated ethylene-propylene, perfluoroalkoxy, copolymers of tetrafluoroethylene and perfluoromethylvinylether, and mixtures thereof.

5. The multi-layer insulation system of claim 1 wherein the sealable component coated onto the polyimide film is a crosslinked fluoropolymer sealable component selected from the group of ethylene-tetrafluoroethylene copolymers, chlorotrifluoroethylene copolymers and terpolymers containing minor amounts of one or more fluorinated comonomers, and mixtures thereof.

6. The multi-layer insulation system of claim 1 wherein the polyimide inner layer demonstrates a high temperature (greater than or equal to 150° C.) adhesive bond strength (ASTM# 1876-00) ranging from about 100 to about 250 grams per inch-width.

7. A multi-layer insulation system for electrical conductors, which comprises:

(a) a fluoropolymer inner layer, wherein, the inner layer is formed by wrapping a fluoropolymer film, in an overlapping fashion, along a portion or length of an electrical conductor, (b) a polyimide middle layer, wherein the polyimide middle layer has a polyimide film, which has been coated with a sealable component and which is formed by wrapping the coated polyimide film, in an overlapping fashion, along a portion or length of the inner layer formed on the electrical conductor, and (c) an extruded, crosslinked fluoropolymer outer layer, wherein the fluoropolymer is selected from the group of copolymers and terpolymers of ethylene-tetrafluoroethylene, and mixtures thereof.

8. The multi-layer insulation system of claim 7, wherein the polyimide film of the polyimide film middle layer is coated with a sealable component and is substantially uniformly sealed to itself in overlapping regions along the length of the inner layer, thereby forming an effective seal against moisture and wherein the sealable component is selected from the group of perfluoropolymer, crosslinked fluoropolymer and polyimide adhesives.

9. The multi-layer insulation system of claim 7, wherein the fluoropolymer inner layer is a non-heat-sealed fluoropolymer film inner layer.

10. The multi-layer insulation system of claim 9, wherein the fluoropolymer film is a polytetrafluoroethylene film.

11. The multi-layer insulation system of claim 10, wherein the polytetrafluoroethylene film is in the form of a skived tape.

12. The multi-layer insulation system of claim 7, wherein the fluoropolymer inner layer is a heat-sealed fluoropolymer film inner layer, wherein the fluoropolymer film is substantially uniformly sealed to itself in overlapping regions along the length of the conductor, thereby forming an effective seal against moisture.

13. A multi-layer insulation system for electrical conductors, which comprises:

(a) a fluoropolymer inner layer, wherein, the inner layer is formed by extruding a fluoropolymer material along a portion or length of an electrical conductor, (b) a polyimide middle layer, wherein the polyimide middle layer has polyimide film, which has been coated with a sealable component and which is formed by wrapping the coated polyimide film, in an overlapping fashion, along a portion or length of the inner layer formed on the electrical conductor, and (c) an extruded, crosslinked fluoropolymer outer layer, wherein the fluoropolymer is selected from the group of copolymers and terpolymers of ethylene-tetrafluoroethylene, and mixtures thereof.

14. The multi-layer insulation system of claims 7 or 13, wherein the fluoropolymer of the fluoropolymer outer layer contains a photosensitive substance rendering the outer layer receptive to laser marking.

15. The multi-layer insulation system of claims 7 or 13, wherein the fluoropolymer of the fluoropolymer inner layer is selected from the group of copolymers of tetrafluoroethylene and perfluoromethylvinylether, perfluoroalkoxy, polytetrafluoroethylene, ethylene-chlorotnfluoroethylene copolymers, ethylene tetrafluoroethylene copolymers, polyvinylidene fluoride, tetrafluoroethylene-hexafluoropropylene-vinylidene fluoride, polyvinyifluoride resins, and mixtures thereof.

16. The multi-layer insulation system of claims 7 or 13, wherein the polyimide middle layer is a non-heat-sealed polyimide middle layer.

17. The multi-layer insulation system of claim 13, wherein the fluoropolymer inner layer is a non-heat-sealed fluoropolymer film inner layer.

18. The multi-layer insulation system of claim 13, wherein the fluoropolymer inner layer is a heat-sealed fluoropolymer film inner layer, wherein the fluoropolymer film is substantially uniformly sealed to itself in overlapping regions along the length of the conductor, thereby forming an effective seal against moisture.

19. The multi-layer insulation system of claim 13, wherein the polyimide middle layer is formed by a polyimide film coated with a sealable component, wherein the polyimide film is substantially uniformly sealed to itself in overlapping regions along the length of the inner layer, thereby forming an effective seal against moisture and wherein the sealable component is selected from the group of perfluoropolymer, crosslinked fluoropolymer and polyimide adhesives.

20. The multi-layer insulation system of claim 1, wherein the extruded fluoropolymer inner layer is a crosslinked extruded fluoropolymer inner layer.

21. The multi-layer insulation system of claims 7 or 13, wherein the fluoropolymer of the fluoropolymer outer layer is an ethylene-tetrafluoroethylene copolymer which comprises 35 to 60% by weight of units derived from ethylene, 35 to 60% by weight of units derived from tetrafluoroethylene and up to 10% by weight of units derived from one or more fluorinated comonomers.

22. A multi-layer insulation system for electrical conductors, which comprises:

(a) a polyimide inner layer, wherein the polyimide inner layer is formed by wrapping a polyimide film, which has been coated with a heat-sealable polyimide adhesive, in an overlapping fashion, along a portion or length of an electrical conductor, wherein, the polyimide film is substantially uniformly sealed to itself in overlapping regions along the length of the conductor, thereby forming an effective seal against moisture, and wherein, the polyimide inner layer demonstrates a high temperature (greater than or equal to 150° C.) adhesive bond strength (ASTM# 1876-00) of greater than 1000 grams per inch-width; and (b) an extruded, crosslinked fluoropolymer outer layer, wherein the fluoropolymer is selected from the group of copolymers and terpolymers of ethylene-tetrafluoroethylene, and mixtures thereof.

23. The multi-layer insulation system of claim 22, wherein the heat-sealable polyimide adhesive is a thermoplastic polyimide that softens and becomes fluid at greater than or equal to 200° C.

24. The multi-layer insulation system of claim 22, wherein the polyimide inner layer demonstrates a high temperature adhesive bond strength of greater than 1500 grams per inch-width.

25. An insulated electrical conductor that comprises an electrical conductor and a multi-layer insulation system, wherein the multi-layer insulation system comprises:

(a) a fluoropolymer inner layer, wherein, the inner layer is formed by wrapping a fluoropolymer film, in an overlapping fashion, along a portion or length of the conductor, (b) a polyimide middle layer, wherein the polyimide middle layer has a polyimide film, which has been coated with a sealable component and which is formed by wrapping the coated polyimide film, in an overlapping fashion, along a portion or length of the inner layer formed on the electrical conductor, and (c) an extruded, crosslinked fluoropolymer outer layer, wherein the fluoropolymer is selected from the group of copolymers and terpolymers of ethylene-tetrafluoroethylene, and mixtures thereof.

26. A process for preparing an insulated electrical conductor, which comprises:

(a) forming a polvimide inner layer on an electrical conductor, wherein, the polyimide inner layer is formed by wrapping a polyimide film, which has been coated with a sealable component, in an overlapping fashion, along a portion or length of the electrical conductor, wherein the sealable component is selected from the group of perfluoropolymer, crosslinkable fluoropolymer and polyimide adhesives, (b) heating the polyimide film to a temperature ranging from about 240° to about 350° C. to cause overlapping regions of the coated film to bond, thereby forming an effective seal against moisture along the length of the conductor, wherein, the polyimide inner layer demonstrates a hiah temperature (greater than or equal to 150° C.) adhesive bond strength (ASTM# 1876-00) ranging from about 100 to about 250 grams per inch-width: and (c) forming a fluoropolyrner outer layer on the inner layer by extruding a fluoropolymer material along a portion or length of that layer; and (d) crosslinking the fluoropolymer outer layer, wherein, if the sealable component comprises a perfiuoropolymer, the fluoropolymer outer layer is crosslinked by exposing it to less than 60 megarads of radiation, with applied voltages ranging from about 50 to about 120 kilo volts.

27. A process for preparing an insulated electrical conductor, which comprises:

(a) forming a fluoropolymer inner layer on an electrical conductor by wrapping a fluoropolymer film, in an overlapping fashion, along a portion or length of the electrical conductor, (b) forming a polyimide middle layer on the fluoropolymer inner layer by wrapping a polyimide film, which has been coated with a sealable component, in an overlapping fashion, along a portion or length of the fluoropolymer inner layer, wherein the sealable component is selected from the group of perfluoropolymer, crosslinked fluoropolymer and polyimide adhesives, (c) heating the polyimide film to a temperature ranging from about 240° to about 350° C. to cause overlapping regions of the film to bond, thereby forming an effective seal against moisture along the length of the conductor, (d) forming a fluoropolymer outer layer on the polyimide middle layer by extruding a fluoropolymer material along a portion or length of that layer, and (e) crosslinking the fluoropolymer outer layer, wherein, when the inner layer or the sealable component comprises a perfluoropolymer, the fluoropolymer outer layer is crosslinked by exposing it to less than 60 megarads of radiation, with applied voltages ranging from about 50 to about 120 kilo volts.

28. An insulated electrical conductor that comprises an electrical conductor and a multi-layer insulation system, wherein the multi-layer insulation system comprises:

(a) a fluoropolymer inner layer, (b) a polyimide middle layer, and (c) an extruded, crosslinked fluoropolymer outer layer, wherein the fluoropolymer is selected from the group of copolymers and terpolymers of ethylene-tetrafluoroethylene, and mixtures thereof, wherein, the insulated electrical conductor is prepared by a process that comprises:

(i) forming a fluoropolymer inner layer on an electrical conductor by wrapping a fluoropolymer film, in an overlapping fashion, along a portion or length of the conductor, (ii) forming a polyimide middle layer on the fluoropolymer inner layer by wrapping a polyimide film, which has been coated with a sealable component, in an overlapping fashion, along a portion or length of the fluoropolymer inner layer, wherein the sealable component is selected from the group of perfluoropolymer, crosslinked fluoropolymer and polyimide adhesives, (iii) heating the polyimide film to a temperature ranging from about 240° to about 350° C. to cause overlapping regions of the coated film to bond, thereby forming an effective seal against moisture along the length of the conductor, (iv) forming a fluoropolymer outer layer on the polyimide middle layer by extruding a fluoropolymer material along a portion or length of the middle layer, and (v) crosslinking the fluoropolymer outer layer, wherein, when the inner layer or the sealable component comprises a perfluoropolymer, the fluoropolymer outer layer is crosslinked by exposing it to less than 60 megarads of radiation, with applied voltages ranging from about 50 to about 120 kilo volts.

29. A multi-layer insulation system for electrical conductors, which comprises:

(a) a polyimide inner layer, wherein the polyimide inner layer is formed by wrapping a polyimide film, which has been coated with a sealable component, in an overlapping fashion, along a portion or length of an electrical conductor, wherein, the polyimide film is substantially uniformly sealed to itself in overlapping regions along the length of the conductor, thereby forming an effective seal against moisture, wherein, the sealable component is selected from the group of perfluoropolymer, crosslinked fluoropolymer and polyimide adhesives, and wherein, the polyimide inner layer demonstrates a high temperature (greater than or egual to 150° C.) adhesive bond strength (ASTM# 1876-00) ranging from about 100 to about 250 grams per inch-width: and (b) an extruded, crosslinked fluoropolymer outer layer, wherein the fluoropolymer is selected from the group of copolymers and terpolymers of ethylene-tetrafluoroethylene, and mixtures thereof.

30. A process for preparing an insulated electrical conductor, which comprises:

(a) forming a fluoropolymer inner layer on an electrical conductor by extruding a fluoropolymer material along a portion or length of the conductor, (b) forming a polyimide middle layer on the fluoropolymer inner layer by wrapping a polyimide film, which has been coated with a sealable component, in an overlapping fashion, along a portion or length of the fluoropolymer inner layer, wherein the sealable component is selected from the group, of perfluoropolymer, crosslinked fluoropolymer and polyimide adhesives, (c) heating the polyimide film to a temperature ranging from about 240° to about 350° C. to cause overlapping regions of the coated film to bond, thereby forming an effective seal against moisture along the length of the conductor, (d) forming a fluoropolymer outer layer on the polyimide middle layer by extruding a fluoropolymer material along a portion or length of that layer; and (e) crosslinking the fluoropolymer outer layer, wherein, if the inner layer or the sealable component comprises a perfluoropolymer, the fluoropolymer outer layer is crosslinked by exposing it to less than 60 megarads of radiation, with applied voltages ranging from about 50 to about 120 kilo volts.

31. A process for preparing an insulated electrical conductor, which comprises:

(a) forming a polyirnide inner layer on an electrical conductor, wherein, the polyimide inner layer is formed by wrapping a polyimide film, which has been coated with a sealable component, in an overlapping fashion, along a portion or length of the electrical conductor, wherein the sealable component is selected from the group of perfluoropolymer, crosslinkable fluoropolymer and polyimide adhesives, (b) forming a polyimide middle layer on the inner layer by wrapping a coated polyimide film, in an overlapping fashion, along a portion or length of the inner layer, (c) heating the polyimide film or films to a temperature ranging from about 240° to about 350° C. to cause overlapping regions of the coated film or films to bond, thereby forming an effective seal against moisture along the length of the conductor, (d) forming a fluoropolymer outer layer on the middle layer by extruding a fluoropolymer material along a portion or length of that layer; and (e) crosslinking the fluoropolymer outer layer, wherein, if the sealable component comprises a perfluoropolymer, the fluoropolymer outer layer is crosslinked by exposing it to less than 60 megarads of radiation, with applied voltages ranging from about 50 to about 120 kilo volts.

32. An insulated electrical conductor that comprises an electrical conductor and a multi-layer insulation system, wherein the multi-layer insulation system comprises:

(a) a polyimide inner layer, wherein, the polyimide inner layer is formed by wrapping a polyimide film, which has been coated with a sealable component, in an overlapping fashion, along a portion or length of an electrical conductor, wherein, the polyimide film is substantially uniformly sealed to itself in overlapping regions along the length of the conductor, thereby forming an effective seal against moisture, wherein, the sealable component is selected from the group of perfluoropolymer, crosslinked fluoropolymer and polyimide adhesives, (b) a polyimide middle layer, wherein the polyimide middle layer is formed by wrapping an optionally coated polyimide film, in an overlapping fashion, along a portion or length of the inner layer formed on the electrical conductor, and (c) an extruded, crosslinked fluoropolymer outer layer, wherein the fluoropolymer is selected from the group of copolymers and terpolymers of ethylene-tetrafluoroethylene, and mixtures thereof.

33. An insulated electrical conductor that comprises an electrical conductor and a multi-layer insulation system, wherein the multi-layer insulation system comprises:

(a) a fluoropolymer inner layer, wherein, the inner layer is formed by extruding a fluoropolymer material along a portion or length of an electrical conductor, (b) a polyimide middle layer, wherein the polyimide middle layer has apolyimide film, which has been coated with a sealable component and which is formed by wrapping the coated polyimide film, in an overlapping fashion, along a portion or length of the inner layer formed on the electrical conductor, and (c) an extruded, crosslinked fluoropolymer outer layer, wherein the fluoropolymer is selected from the group of copolymers and terpolymers of ethylene-tetrafluoroethylene, and mixtures thereof.

34. An insulated electrical conductor that comprises an electrical conductor and a multi-layer insulation system, wherein the multi-layer insulation system comprises:

(a) a polyimide inner layer, wherein, the polyimide inner layer is formed by wrapping a polyimide film, which has been coated with a sealable component, in an overlapping fashion, along a portion or length of the electrical conductor, wherein, the polyimide film is substantially uniformly sealed to itself in overlapping regions along the length of the conductor, thereby forming an effective seal against moisture, wherein, the sealable component is selected from the group of perfluoropolymer, crosslinked fluoropolymer and polyimide adhesives, and wherein, the polyimide inner layer demonstrates a high temperature (greater than or equal to 150° C.) adhesive bond strength (ASTM # 1876-00) ranging from about 100 to about 250 grams per inch-width , and (b) an extruded, crosslinked fluoropolymer outer layer, wherein the fluoropolymer is selected from the group of copolymers and terpolymers of ethylene-tetrafluoroethylene, and mixtures thereof.

* * * * *

UNITED STATES PATENT AND TRADEMARK OFFICE

CERTIFICATE OF CORRECTION

PATENT NO. : 6,781,063 B2
DATED : August 24, 2004
INVENTOR(S) : Young Joon Kim et al.

It is certified that error appears in the above-identified patent and that said Letters Patent is hereby corrected as shown below:

Columns 13-16,

TABLE 1, Under Example 1A, 1B, 1C, ID, 1E, change "0 05" to -- 0.05--.
TABLE 1, Under Example IA, 1B, 1C, 1D, 1E, change "0 20" to -- 0.20 --.
TABLE 1, Under Example IA, 1B, 1C, 1D, 1E, change "6 50" to -- 6.50 --.
TABLE 1, Under Example 2, change "0 13" to -- 0.13 --.
TABLE 1, Under Example 2, change "6 69" to -- 6.69 --.
TABLE 1, Under Example 3A, 3B, 3C, change "0 08" to -- 0.08 --.
TABLE 1, Under Example 3A, 3B, 3C, change "0 13" to -- 0.13 --.
TABLE 1, Under Example 3A, 3B, 3C, change "0 20" to -- 0.20 --.
TABLE 1, Under Example 3A, 3B, 3C, change "6 37" to -- 6.37 --.
TABLE 1, Under Example 4A, 4B, change "0 06" to -- 0.06 --.
TABLE 1, Under Example 4A, 4B, change "0 13" to -- 0.13 --.
TABLE 1, Under Example 4A, 4B, change "0 20" to -- 0.20 --.
TABLE 1, Under Example 4A, 4B, change "6 40" to -- 6.40 --.
TABLE 1, Under Example 5, change "0 05" to -- 0.05 --.
TABLE 1, Under Example 5, change "0 13" to -- 0.13 --.
TABLE 1, Under Example 5, change "0 20" to -- 0.20 --.
TABLE 1, Under Example 5, change "6 50" to -- 6.50 --.
TABLE 1, Under Example 6, change "0 03" to -- 0.03 --.
TABLE 1, Under Example 6, change "0 05" to -- 0.05 --.
TABLE 1, Under Example 6, change "0 21" to -- 0.21 --.
TABLE 1, Under Example 6, change "6 69" to -- 6.69 --.
TABLE 1, Under Example 7, change "0 03" to -- 0.03 --.
TABLE 1, Under Example 7, change "0 05" to -- 0.05 --.
TABLE 1, Under Example 7, change "0 13" to -- 0.13 --.
TABLE 1, Under Example 7, change "0 20" to -- 0.20 --.
TABLE 1, Under Example 7, change "6 62" to -- 6.62 --.
TABLE 1, Under Example 8, change "0 03" to -- 0.03 --.
TABLE 1, Under Example 8. change "0 04" to -- 0.04 --.
TABLE 1, Under Example 8, change "0 13" to -- 0.13 --.
TABLE 1, Under Example 8, change "0 20" to -- 0.20 --.
TABLE 1, Under Example 8, change "6 46" to -- 6.46 --.
TABLE 1, Under Example 9, change "0 03" to -- 0.03 --.
TABLE 1, Under Example 9, change "004" to -- 0.04 --.
TABLE 1, Under Example 9, change "0 21" to -- 0.21 --.
TABLE 1, Under Example 9, change "6 71" to -- 6.71 --.
TABLE 1, Under Example C-1, change "0 06" to -- 0.06 --.

UNITED STATES PATENT AND TRADEMARK OFFICE

CERTIFICATE OF CORRECTION

PATENT NO. : 6,781,063 B2
DATED : August 24, 2004
INVENTOR(S) : Young Joon Kim et al.

It is certified that error appears in the above-identified patent and that said Letters Patent is hereby corrected as shown below:

Columns 13-16 (cont'd),
TABLE 1, Under Example C-1, change "013" to -- 0.13 --.
TABLE 1, Under Example C-1, change "0 20" to -- 0.20 --.
TABLE 1, Under Example C-1, change "6 89" to -- 6.89 --.
TABLE 1, Under Example C-2, change "0 09" to -- 0.09 --.
TABLE 1, Under Example C-2, change "013" to -- 0.13 --.
TABLE 1, Under Example C-2, change "0 20" to -- 0.20 --.
TABLE 1, Under Example C-2, change "6 60" to -- 6.60 --.
TABLE 5, Under Sandpaper Abrasion Resistance (mm), Total Insulation Thickness (mm), Example 5, change "0 200" to -- 0.200 --.
TABLE 5, Under Sandpaper Abrasion Resistance (mm), Cut-Through Resistance (1bs), 150', Example 5, change "73 9" to -- 73.9 --.
TABLE 5, Under Sandpaper Abrasion Resistance (mm), Cut-Through Resistance (1bs), 200'C, Example 5, change "53 9" to -- 53.9 --.
TABLE 5, Under Sandpaper Abrasion Resistance (mm), Cut-Through Resistance (1bs), 260°C, Example 5, change "66 2" to -- 66.2 --.
TABLE 5, Under Sandpaper Abrasion Resistance (mm), Total Insulation Thickness (mm), Example 6, change "0 210" to -- 0.210 --.
TABLE 5, Under Sandpaper Abrasion Resistance (mm), Cut-Through Resistance (1bs), 23°C, Example 6, change "95 7" to -- 95.7 --.
TABLE 5, Under Sandpaper Abrasion Resistance (mm), Cut-Through Resistance (1bs), 150°C, Example 6, change "64 0" to -- 64.0 --.
TABLE 5, Under Sandpaper Abrasion Resistance (mm), Cut-Through Resistance (1bs), 260°C, Example 6, change "51 3" to -- 51.3 --.
TABLE 5, Under Sandpaper Abrasion Resistance (mm), Total Insulation Thickness (mm), Example 7, change "0 198" to -- 0.198 --.
TABLE 5, Under Sandpaper Abrasion Resistance (mm), Cut-Through Resistance (1bs), 23"C, Example 7, change "89 6" to -- 89.6 --.
TABLE 5, Under Sandpaper Abrasion Resistance (mm), Cut-Through Resistance (1bs), 200'C, Example 7, change "50 2" to -- 50.2 --.
TABLE 5, Under Sandpaper Abrasion Resistance (mm), Cut-Through Resistance (1bs), 260"C, Example 7, change "46 7" to -- 46.7 --.
TABLE 5, Under Sandpaper Abrasion Resistance (mm), Total Insulation Thickness (mm), Example 8, change "0 198" to -- 0.198 --.
TABLE 5, Under Sandpaper Abrasion Resistance (mm), Cut-Through Resistance (1bs), 23°C, Example 8, change "80 0" to -- 80.0 --.
TABLE 5, Under Sandpaper Abrasion Resistance (mm), Cut-Through Resistance (1bs), 150°C, Example 8, change "75 0" to -- 75.0 --.
TABLE 5, Under Sandpaper Abrasion Resistance (mm), Cut-Through Resistance (1bs), 200°C, Example 8, change "64 0" to -- 64.0 --.

UNITED STATES PATENT AND TRADEMARK OFFICE

CERTIFICATE OF CORRECTION

PATENT NO. : 6,781,063 B2
DATED : August 24, 2004
INVENTOR(S) : Young Joon Kim et al.

It is certified that error appears in the above-identified patent and that said Letters Patent is hereby corrected as shown below:

Columns 13-16 (cont'd),
TABLE 5, Under Sandpaper Abrasion Resistance (mm), Cut-Through Resistance (1bs), 260'C, Example 8, change "54 0" to -- 54.0 --.
TABLE 5, Under Sandpaper Abrasion Resistance (mm), Total Insulation Thickness (mm), Example 9, change "0 210" to -- 0.210 --.
TABLE 5, Under Sandpaper Abrasion Resistance (mm), Cut-Through Resistance (1bs), 23°C, Example 9, change "79 0" to -- 79.0 --.
TABLE 5, Under Sandpaper Abrasion Resistance (mm), Cut-Through Resistance (lbs), 150°C, Example 9. change "67 0" to -- 67.0 --.
TABLE 5, Under Sandpaper Abrasion Resistance (mm), Cut-Through Resistance (1bs), 200°C, Example 9, change "60 0" to -- 60.0 --.
TABLE 5, Under Sandpaper Abrasion Resistance (mm), Cut-Through Resistance (1bs), 260'C, Example 9, change "52 0" to -- 52.0 --.
TABLE 5, Under Sandpaper Abrasion Resistance (mm), Total Insulation Thickness (mm), Example C-1, change "02 03" to -- 0.203--.
TABLE 5, Under Sandpaper Abrasion Resistance (mm), Total Insulation Thickness (mm), Example C-2, change "0 203" to -- 0.203 --.
TABLE 5, Under Sandpaper Abrasion Resistance (mm), Cut-Through Resistance (1bs), 150°C Example C-2, change "5 5" to -- 5.5 --.
TABLE 5, Under Wet Arc Propagation Resistance (# of bundles, # of wires passed), Total Insulation Thickness (mm), Example 5, change "0 200" to -- 0.200 --.
TABLE 5, Under Wet Arc Propagation Resistance, (# of bundles, # of wires passed), Total Insulation Thickness (mm), Example 6, change "0 210" to -- 0.210 --.
TABLE 5, Under Wet Arc Propagation Resistance, (# of bundles, # of wires passed), Total Insulation Thickness (mm), Example 7, change "0 198" to -- 0.198 --.
TABLE 5, Under Wet Arc Propagation Resistance, (# of bundles, # of wires passed), Total Insulation Thickness (mm), Example 8, change "0 198" to -- 0.198 --.
TABLE 5, Under Wet Arc Propagation Resistance (# of bundles, # of wires passed), Total Insulation Thickness (mm), Example 9, change "0 210" to -- 0.210 --.
TABLE 5, Under Wet Arc Propagation Resistance (# of bundles, # of wires passed), Total Insulation Thickness (mm), Example C-1, change "0 203" to -- 0.203 --.
TABLE 5, Under Wet Arc Propagation Resistance (# of bundles, # of wires passed), Total Insulation Thickness (mm), Example C-2, change "0 203" to -- 0.203 --.

Column 27,
Line 34, change "2" to -- 1 --.

UNITED STATES PATENT AND TRADEMARK OFFICE

CERTIFICATE OF CORRECTION

PATENT NO. : 6,781,063 B2
DATED : August 24, 2004
INVENTOR(S) : Young Joon Kim et al.

It is certified that error appears in the above-identified patent and that said Letters Patent is hereby corrected as shown below:

Column 29,
Line 17, change "1" to -- 13 --.

Column 30,
Line 9, change, "polvimide" to -- polyimide --.
Line 23, change "hiah" to -- high --.
Line 32, change "perfiuoropolymer" to -- perfluoropolymer --.

Signed and Sealed this

Fifth Day of April, 2005

JON W. DUDAS
*Director of the United States Patent and Trademark Office*